US007976352B2

(12) United States Patent
Nishimura

(10) Patent No.: US 7,976,352 B2
(45) Date of Patent: Jul. 12, 2011

(54) AUDIO CONNECTOR

(75) Inventor: Yoji Nishimura, Tokyo (JP)

(73) Assignee: Furutech Co., Ltd., Tokyo (JP)

( * ) Notice: Subject to any disclaimer, the term of this patent is extended or adjusted under 35 U.S.C. 154(b) by 0 days.

(21) Appl. No.: 12/732,305

(22) Filed: Mar. 26, 2010

(65) Prior Publication Data

US 2010/0248542 A1 Sep. 30, 2010

(30) Foreign Application Priority Data

Mar. 27, 2009 (TW) ..... 98110069 A

(51) Int. Cl.
*H01R 13/16* (2006.01)

(52) U.S. Cl. ..... 439/814

(58) Field of Classification Search ..... 439/810–814, 439/886

See application file for complete search history.

(56) References Cited

U.S. PATENT DOCUMENTS 3,984,170 A * 10/1976 Marechal ..... 439/814
4,427,258 A * 1/1984 Mueller ..... 439/814
4,611,876 A * 9/1986 Barrabes ..... 439/733.1
4,810,212 A * 3/1989 Norden ..... 439/709
5,007,864 A * 4/1991 Stutz, Jr. ..... 439/651
5,032,092 A * 7/1991 Linn ..... 439/723
5,533,913 A * 7/1996 Boehm et al. ..... 439/810
6,663,443 B1 * 12/2003 Smith et al. ..... 439/811
7,377,795 B2 * 5/2008 Vicich et al. ..... 439/83
7,384,317 B1 * 6/2008 Pijoan Parellada et al. .. 439/814
2002/0081914 A1 * 6/2002 Takaya et al. ..... 439/810
2008/0268721 A1 * 10/2008 Waltz ..... 439/793

* cited by examiner

*Primary Examiner* — Gary F. Paumen
(74) *Attorney, Agent, or Firm* — Peter F. Corless; Steven M. Jensen; Edwards Angell Palmer & Dodge LLP

(57) ABSTRACT

An audio connector includes: a body; a terminal plug fixed in position to the body and having a guide plate penetrating the body for supporting and being electrically connected to the conductive ends of a multi-core wire; a wire collecting member disposed inside the body, wherein the wire collecting member and the guide plate collectively define a receiving space for receiving and collecting the conductive ends of the multi-core wire; and a pressing member disposed inside the wire collecting member for pressing the conductive ends of the multi-core wire in conjunction with the guide plate and the wire collecting member, wherein a maximum width of the receiving space is smaller than or equal to that of the pressing surface of the pressing member.

20 Claims, 6 Drawing Sheets

AUDIO CONNECTOR

BACKGROUND OF THE INVENTION

1. Field of the Invention

The present invention relates to audio connectors, and more particularly, to an audio connector with one end connected to an external device.

2. Description of Related Art

Audio connectors are connected to external devices for signal transmission and usually furnished with banana plugs or spade plugs.

FIG. 1 is a fragmentary section of a conventional audio connector with a banana plug. As shown in the drawing, for signal transmission, an audio connector 1 has one end provided with a banana plug 11 for electrical connection with an external device to enable signal transmission, and the other end of the audio connector 1 has a pressing member 13 for pressing the conductive ends 121 of a multi-core wire 12, which is disposed perpendicular to the audio connector 1. By pressing the multi-core wire 12, a corresponding friction force is generated so as to secure the multi-core wire 12 in position to the audio connector 1. Meanwhile, the multi-core wire 12 is in contact with an intermediary conductor (not shown) of the audio connector 1 for being indirectly electrically connected to the banana plug 11. Since the multi-core wire 12 is electrically connected to the banana plug 11 through the intermediary conductor instead of being directly connected to the banana plug 11, signals need to be transmitted through different conductors, which may generally result in signal attenuation and noise interference.

Further, since the audio connector 1 and the multi-core wire 12 are connected perpendicularly to each other, the conductive ends 121 of the multi-core wire 12 may easily break or fall off after repeated use or under shear stresses. As a result, the multi-core wire 12 may be separated from the audio connector 1.

FIG. 2 shows a sectional view along line AA of FIG. 1. As shown in FIG. 2, the pressing member 13 cannot effectively press the conductive ends 121 at an overall scale. That is, only a small portion of the conductive ends 121 of the multi-core wire 12 is pressed by the pressing member 13, which usually cannot provide sufficient resistance to shear stresses or pulling forces, thereby easily leading to separation of the multi-core wire 12 from the audio connector 1.

Therefore, there is a need to provide an audio connector so as to overcome the above-described drawbacks.

SUMMARY OF THE INVENTION

In light of the above-mentioned drawbacks of the prior art, it is an objective of the present invention to provide an audio connector so as to overcome drawbacks of conventional audio connectors, such as signal attenuation and noise interference.

Another objective of the present invention is to provide an audio connector that solves a problem facing conventional audio connectors: only a small portion of the conductive ends of the multi-core wire connected to the audio connector is utilized to resist against external forces.

A further objective of the present invention is to provide an audio connector that prevents the conductive ends of the multi-core wire from being damaged by shear forces.

In summary, the present invention provides an audio connector, which comprises: a body; a terminal plug fixed in position to the body and comprising a guide plate penetrating the body for supporting and being electrically connected to the conductive ends of a multi-core wire; a wire collecting member disposed inside the body and configured to define, together with the guide plate, a receiving space for receiving and collecting the conductive ends of the multi-core wire; and a pressing member disposed inside the wire collecting member for pressing the conductive ends of the multi-core wire in conjunction with the guide plate and the wire collecting member, wherein a maximum width of the receiving space is smaller than or equal to that of the pressing surface of the pressing member, thereby fixing the multi-core wire to the terminal plug.

According to an embodiment of the present invention, the body further comprises a through hole for receiving the pressing member entering the wire collecting member, wherein the pressing member is a screw and the through hole is a screw hole. The body further has an opening that exposes a portion of the conductive ends of the multi-core wire so as to facilitate a process as a soldering process of the conductive ends. The wire collecting member has a groove facing the guide plate for collecting the conductive ends of the multi-core wire, wherein a maximum width of the groove is smaller than or equal to that of the pressing surface of the pressing member.

As for another embodiment, the guide plate additionally has a concave portion for collecting the conductive ends of the multi-core wire, wherein a maximum width of the concave portion is smaller than or equal to that of the pressing surface of the pressing member. The terminal plug is made of Cu and an electroplating layer made of Rh or Au is formed on the terminal plug through nickel-free electroplating. The terminal plug is selected from a group consisting of a banana plug, a spade plug, a microphone plug, a TRS plug, a BNC plug, an earphone plug, and a RCA plug.

In the present embodiment, the audio connector further comprises a pin for fixing the terminal plug to the body. The audio connector further comprises a casing provided to the body for protecting the body and shielding electromagnetic interference (EMI) that might otherwise affect the body. Therein, the casing is made of a nonmagnetic stainless steel, carbon fiber, or a combination thereof. The audio connector further comprises a holding unit disposed onto one end of the body distal to the terminal plug for holding encircledly an external insulating layer of the multi-core wire. Therein, the holding unit comprises a holding member with holding fingers in contact with an inner wall of the body; and a fixing ring for pushing the holding member to move towards the inside of the body, wherein the holding fingers are pressed by the inner wall of the body so as to hold encircledly the external insulating layer of the multi-core wire.

According to another embodiment of the present invention, the audio connector further comprises a thimble unit disposed onto one end of the body proximal to the terminal plug and configured to spread the plate pieces of the terminal plug in a resilient deformable manner. The thimble unit comprises: a thimble base with a thimble penetrating the terminal plug; and a pushing member for pushing the thimble base to move towards the terminal plug such that the thimble spreads the plate pieces of the terminal plug in a resilient deformable manner. The thimble unit further comprises a resilient element with two ends thereof being in contact with the terminal plug and the thimble base, respectively, so as to provide a resilient force to make the thimble base move away from the terminal plug and make the plate pieces of the terminal plug return to an original state before the resilient deformation. The resilient element is a spring.

According to the present invention, the conductive ends of the multi-core wire is directly connected to the guide plate of the terminal plug instead of being connected to the terminal plug through an intermediary conductor as in the prior art, thereby efficiently preventing signal transmission in different conductors and overcoming signal attenuation and noise interference occurring in the prior art. Further, since the conductive ends of the multi-core wire is collected by the wire collecting member, the conductive ends can always be pressed by the pressing member so as to overcome the conventional drawback that only a small portion of the conductive ends of the multi-core wire is utilized to resist against external forces. Furthermore, the conductive ends of the multi-core wire is protected by the body and the guide plate from damage by shear stresses. Through combination of the body, holding fingers and fixing ring, the external insulating layer of the multi-core wire can be fixed so as to prevent the multi-core wire from falling off due to external forces.

DETAILED DESCRIPTION OF PREFERRED EMBODIMENTS

The following illustrative embodiments are provided to illustrate the disclosure of the present invention, these and other advantages and effects can be apparent to those skilled in the art after reading the disclosure of this specification.

Figure 2:
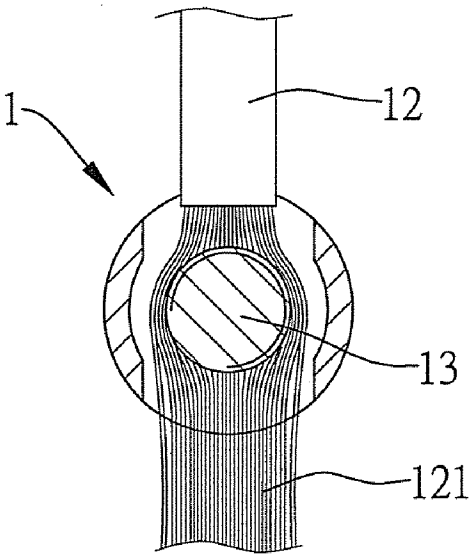
FIG. 2 (PRIOR ART)
FIG. 2 (PRIOR ART) is a sectional view along a line AA of FIG. 1.
Figure 1:
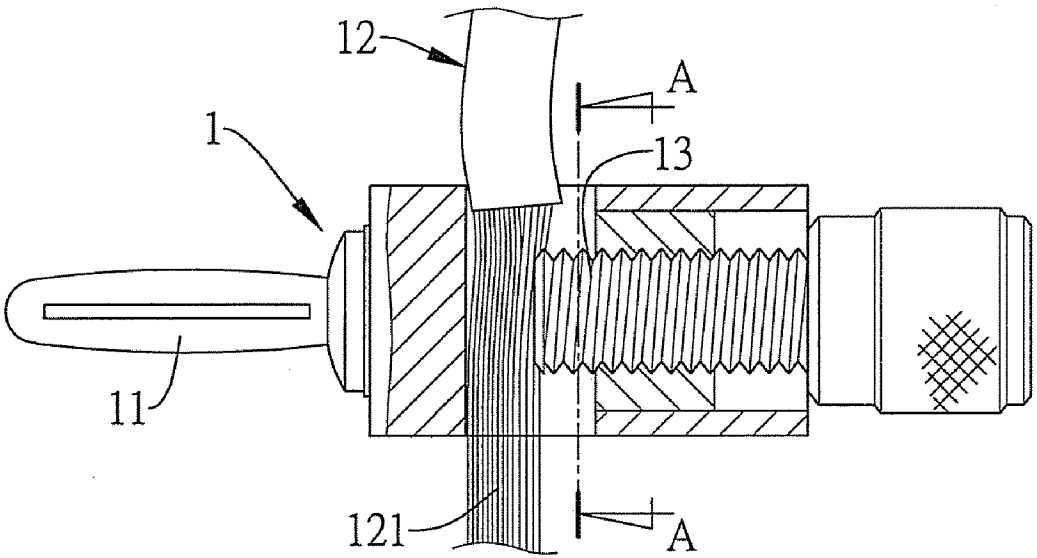
FIG. 1 (PRIOR ART)
FIG. 1 (PRIOR ART) is a fragmentary sectional view of a conventional audio connector with a banana plug.
Figure 3:
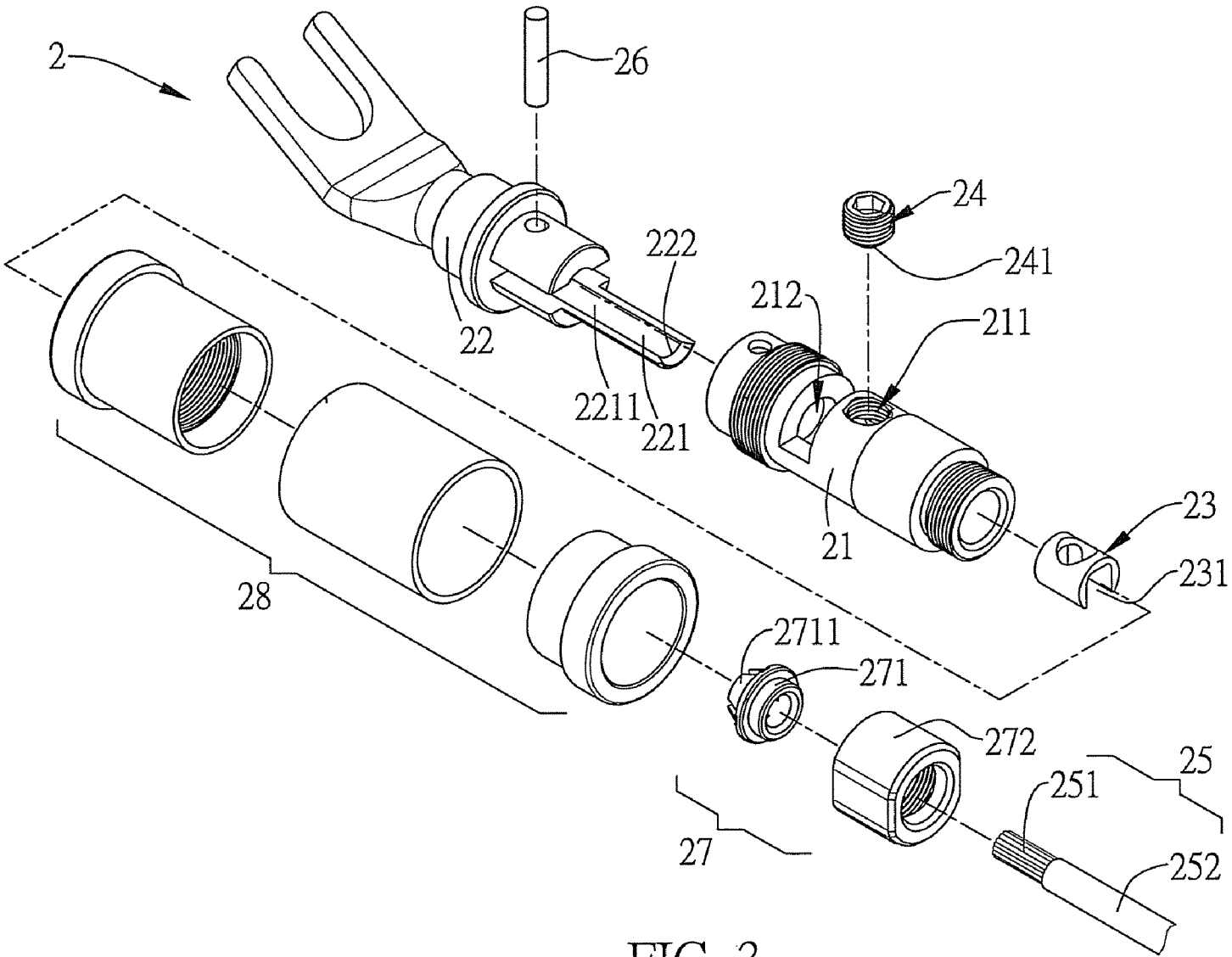
FIG. 3 is an exploded view of an audio connector according to an embodiment of the present invention.
Figure 5:
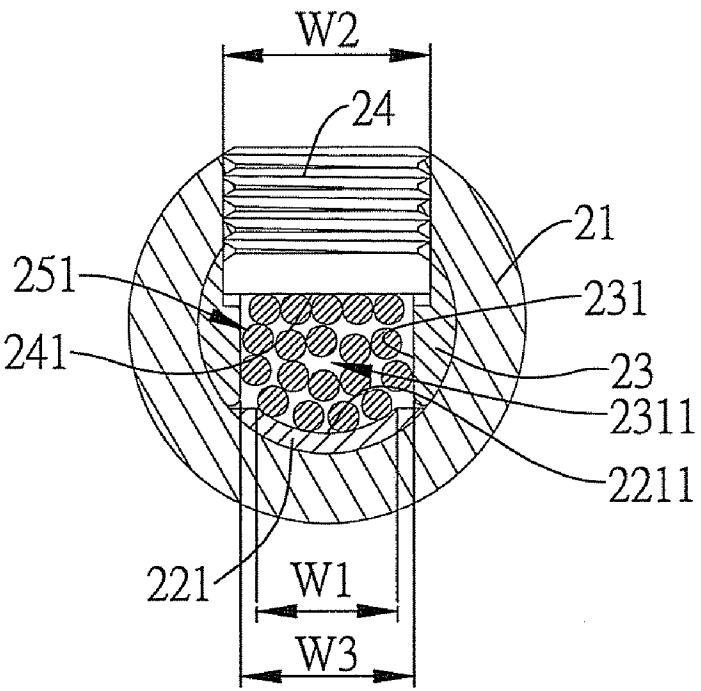
FIG. 5 is a sectional view along a line BB of FIG. 4.
Figure 4:
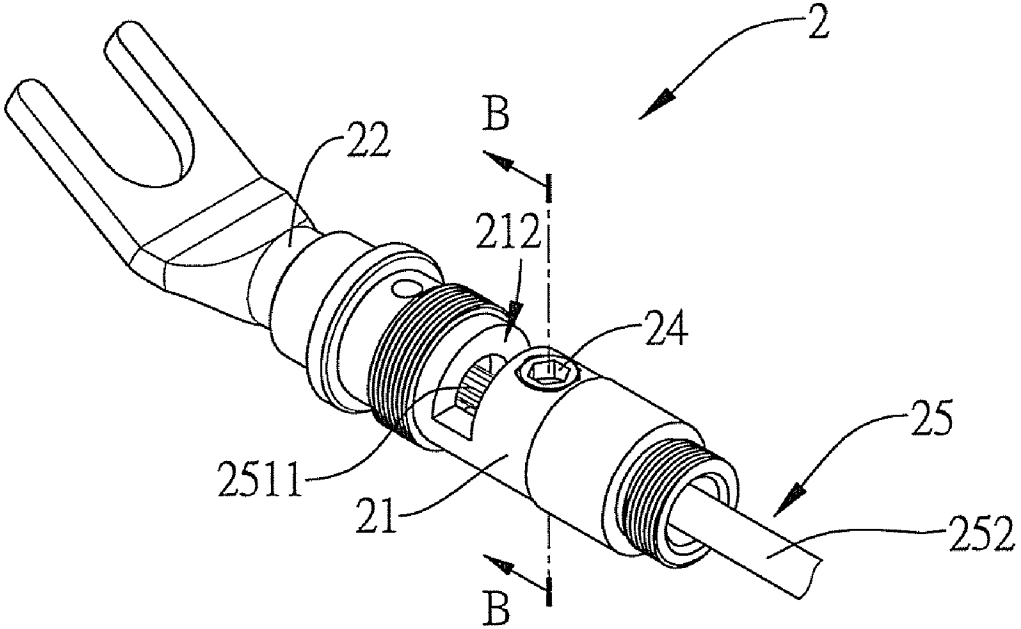
FIG. 4 is an assembly view of a portion of the components of the audio connector of FIG. 3.

FIG. 3 is an exploded view of an audio connector according to an embodiment of the present invention, FIG. 4 is an assembly view of a portion of the components of the audio connector of FIG. 3, and FIG. 5 is a sectional view along a line BB of FIG. 4. Referring to FIGS. 3 to 5, the audio connector 2 is a spade-shaped audio connector, which comprises a body 21, a terminal plug 22, a wire collecting member 23 and a pressing member 24.

The body 21 is made of stainless steel in the present embodiment, but not limited thereto. The terminal plug 22 is a spade plug, which makes an electrical contact with an external device for signal transmission. Alternatively, the terminal plug 22 may be a banana plug, a microphone plug, a TRS plug, a BNC plug, an earphone plug, a RCA plug or any other coaxial plug. The terminal plug 22 is secured in position to the body 21 through a pin 26. One end of the terminal plug 22 has a guide plate 221 that penetrates the body 21 for supporting and being electrically connected to the conductive ends 251 of a multi-core wire 25. Therefore, the multi-core wire 25 is protected by the body 21 and the guide plate 221 against shear stresses. Meanwhile, the multi-core wire 25 is directly electrically connected to the terminal plug 22 without the need of the conventional intermediary conductor, thereby overcoming the conventional drawbacks of signal attenuation and noise interface. It should be noted that instead of using a pin for securing the terminal plug 22 in position to the body 21, other securing mechanisms such as a screw mechanism can be used.

The guide plate 221 has a concave portion 2211, which has a concave arc-shaped surface for collecting the conductive ends 251 of the multi-core wire 25. The maximum concave width W1 of the concave portion 2211 is, for example, substantially smaller or equal to the maximum width W2 of the pressing surface 241 of the pressing member 24 such that the conductive ends 251 can always be pressed by the pressing member 24, thereby providing sufficient resistance to external forces and efficiently securing the multi-core wire 25 in position to the terminal plug 22. It should be noted that the relationship between the concave portion 221 and the pressing member 24 can be modified and is not limited to the above-described content.

In the present embodiment, the terminal plug 22 is made of Cu and integrally formed with the guide plate 221. An electroplated layer 222 made of Rh or Au is formed on the terminal plug 22 through nickel-free electroplating. As a result, the terminal plug 22 has an excellent signal transmission capability of copper, and meanwhile has anti-oxidant and wear-resistant properties and is capable of preventing generation of an interfering magnetic field because of Rh or Au, which efficiently overcomes the drawbacks of conventional audio connectors, that is, signal attenuation and noise interference, overcomes wear and tear and oxidation of the terminal plug, and prolongs the service life of the audio connectors. It should be noted that the terminal plug 22 is not limited to the above-described materials. Also, the method of forming the electroplating layer 222 is not limited to nickel-free electroplating.

The wire collecting member 23 is disposed inside the body 21. The wire collecting member 23 and the guide plate 221 collectively define a receiving space 2311 for receiving and collecting the conductive ends 251 of the multi-core wire 25. The pressing member 24 is disposed inside the wire collecting member 23 for pressing the conductive ends 251 of the multi-core wire 25 in conjunction with the guide plate 221 and the wire collecting member 23. The pressing effect is achieved by reducing the size of the receiving space 2311 formed by the guide plate 221 and the wire collecting member 23 through the pressing member 24. Further, the maximum width W3 of the receiving space 2311 is, for example, substantially smaller or equal to the maximum width W2 of the pressing surface 241 of the pressing member 24 such that the whole conducive ends 251 can be pressed by the pressing member 24 and accordingly the whole conductive ends 251 can be utilized to resist against external forces, thereby securing the multi-core wire 25 in position to the terminal plug 22.

In the present embodiment, the body 21 has a through hole 211 for receiving the pressing member 24 entering the wire collecting member 23. Therein, the pressing member 24 is a screw and the through hole 211 is a screw hole, which however is not limited thereto. Further, the wire collecting member 23 has a groove 231 facing the guide plate 221 for collecting the conductive ends 251 of the multi-core wire 25. The maximum length W3 of the groove 231 is, for example, substantially smaller than or equal to the maximum width W2 of the pressing surface 241 of the pressing member 24 such that the whole conductive ends 251 of the multi-core wire 25 can be pressed by the pressing member 24 for resisting against external forces and securing the multi-core wire 25 in position to the terminal plug 22. In the present embodiment, the groove 231 has an n-shaped cross-section. Alternatively, the cross-section of the groove 231 is of a U-shape or an inverted-trapezoid shape.

The audio connector 2 further comprises a casing 28 screwingly disposed on the body 21. But it should be noted that the disposing method of the casing 28 can be modified as needed. The casing 28 is made of, but is not limited to, nonmagnetic stainless steel, carbon fiber, or a combination thereof for protecting the body 21 against electromagnetic interference (EMI).

Figure 7:
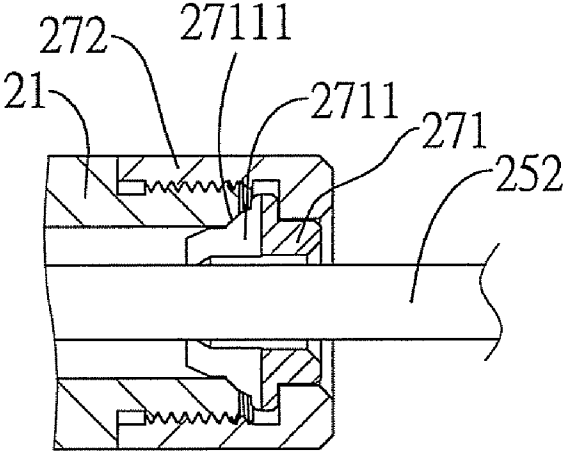
FIG. 7 is a fragmentary sectional view along a line CC of FIG. 6.
Figure 6:
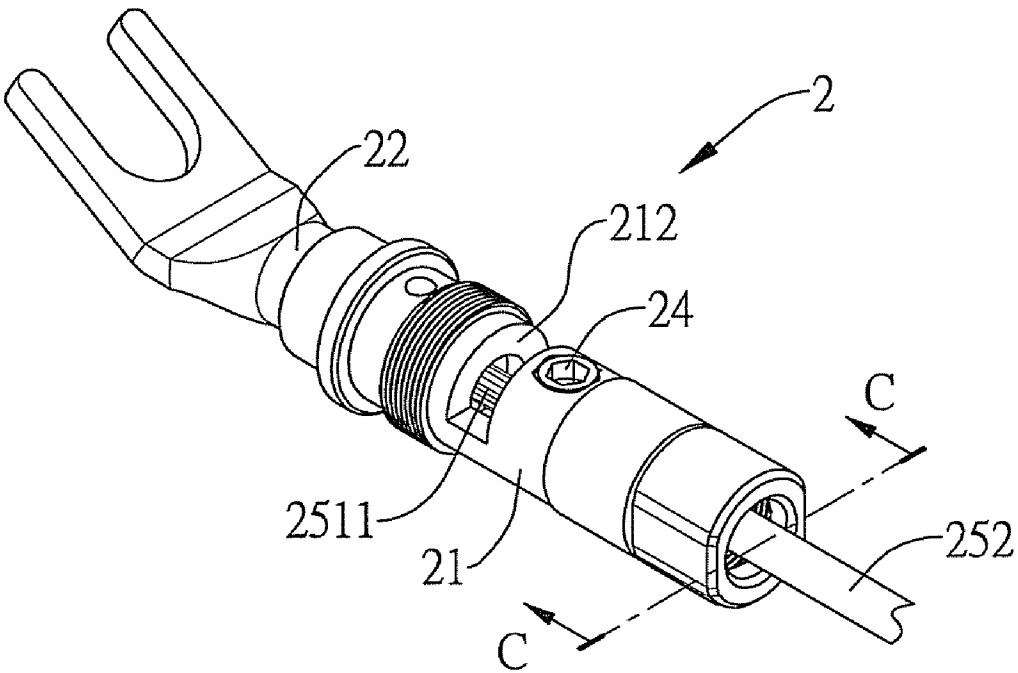
FIG. 6 is an assembly view of a portion of the components of the audio connector of FIG. 3.

FIG. 6 is an assembly view of a portion of the components of the audio connector of FIG. 3, and FIG. 7 is a fragmentary sectional view along a line CC of FIG. 6. Referring to FIG. 3 and FIGS. 6 and 7, the audio connector 2 further comprises a holding unit 27 disposed onto one end of the body 21 distal to the terminal plug 22 for holding encircledly an insulating layer 252 of the multi-core wire 25 so as to prevent the multi-core wire 25 from moving or breaking due to an external pulling force.

The holding unit 27 comprises a holding member 271 and a fixing ring 272. The holding member 271 has a plurality of holding fingers 2711 each of which has a pushing surface 27111 that is in contact with an inner wall of the body 21. The fixing ring 272 is a stainless steel column with a screw hole. The column is screwingly disposed on the body 21 and has a mechanism for pushing the holding member 271. Through the rotation of the fixing ring 272, the holding member 271 is pushed to move towards the inside of the body 21. Thus, the pushing surfaces 27111 of the holding fingers 2711 are pressed by the inner wall of the body 21 so as to cause the holding fingers 2711 to hold encircledly the external insulating layer 252 of the multi-core wire 25. Hence, given a combination of the body 21, the holding fingers 2711 and the fixing ring 272, the external insulating layer 252 of the multi-core wire 25 is fixed in position so as to prevent the multi-core wire 25 from falling off due to an external force. It should be noted that the structure of the holding unit 27 is not limited to the above-described content. For example, the structure for pushing the holding member 271 can be directly formed on the casing 28, thereby simplifying the manufacturing process and saving the material cost.

The body 21 further has a through hole 212 for exposing a part 2511 of the conductive ends 251 of the multi-core wire 25, thus facilitating a soldering process of the part 2511.

The audio connector according to the present embodiment comprises a body, a terminal plug, a wire collecting member and a pressing member. In the present embodiment, the conductive ends of the multi-core wire is directly connected to the guide plate of the terminal plug instead of being connected to the terminal plug through an intermediary conductor as in the prior art, thereby efficiently preventing signal transmission in different conductors and accordingly overcoming signal attenuation and noise interference occurring in the prior art. Further, since the conductive ends of the multi-core wire is collected by the wire collecting member in the present embodiment, the conductive ends can always be pressed by the pressing member so as to overcome the conventional drawback that only a small portion of conductive ends of the multi-core wire is utilized to resist against external forces. Furthermore, the end portion of the multi-core wire can be protected by the body and the guide plate from damage by shear stresses. In addition, given a combination of the body, holding fingers and fixing ring, the external insulating layer of the multi-core wire is fixed in position so as to prevent the multi-core wire from falling off due to external forces.

Figure 8:
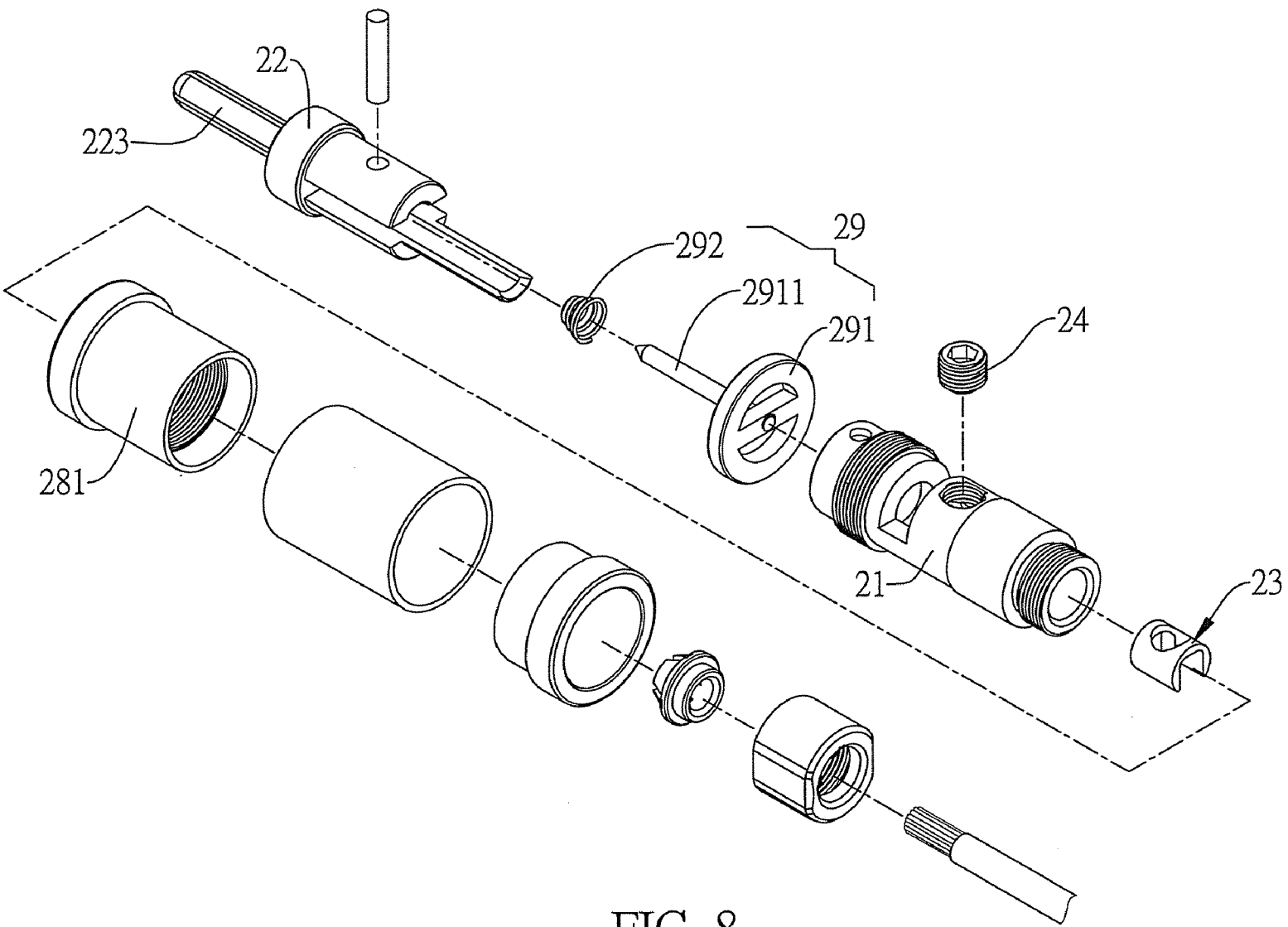
FIG. 8 is an exploded view of an audio connector according to another embodiment of the present invention.
Figure 9:
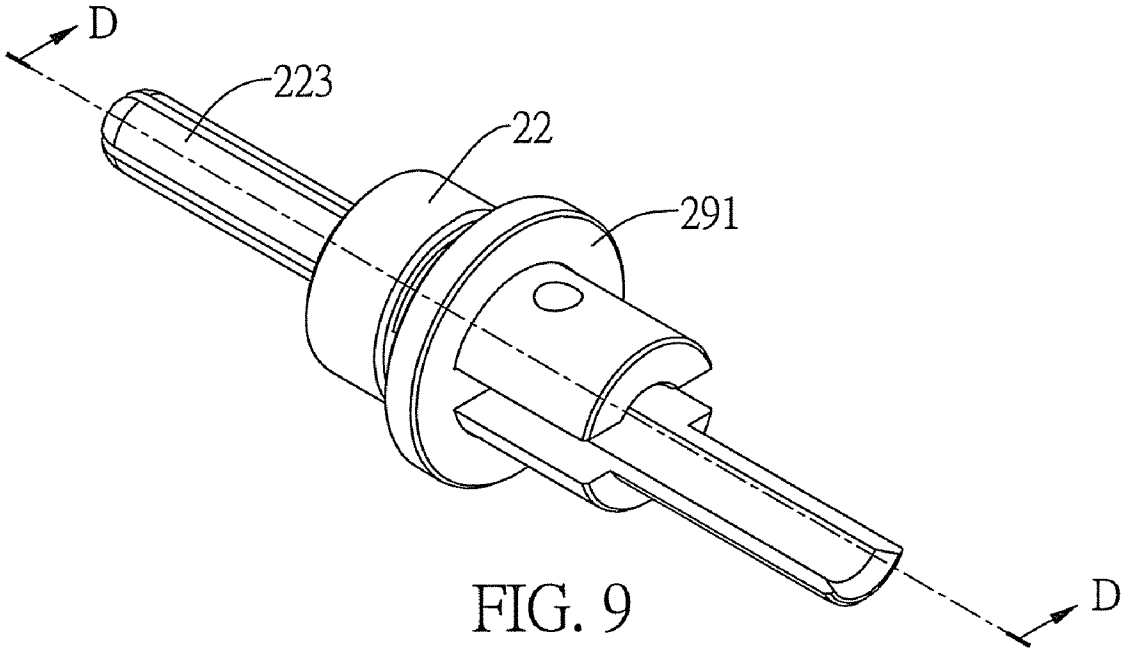
FIG. 9 is an assembly view of a portion of the components of the audio connector of FIG. 8.
Figure 10:
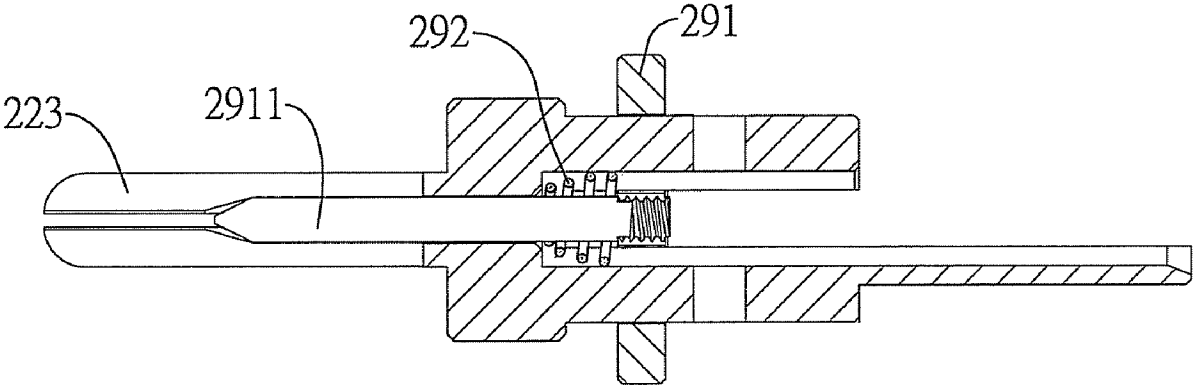
FIG. 10 is a sectional view along a line DD of FIG. 9.

FIG. 8 is an exploded view of an audio connector according to another embodiment of the present invention, FIG. 9 is an assembly view of a portion of the components of the audio connector of FIG. 8, and FIG. 10 is a sectional view along a line DD of FIG. 9. The audio connector of the present embodiment is similar to the above-described embodiment. For simplification, components of the present embodiment that are same as or similar to the above-described embodiment are denoted by same or similar reference numerals.

The present embodiment is different from the previous embodiment in that, in the present embodiment, the terminal plug is a banana plug, and the plate pieces of the terminal plug can spread in a resilient deformable manner or return to the original non-resilient-deformable state as needed.

Referring to FIGS. 8 to 10, the audio connector 2 of the present embodiment comprises a body 21, a terminal plug 22, a wire collecting member 23, a pressing member 24 and a thimble unit 29. The thimble unit 29 comprises a thimble base 291 and a pushing member 281. The thimble unit 29 is disposed onto one end of the body 21 proximal to the terminal plug 22 and configured to spread the plate pieces 223 of the terminal plug 22 in a resilient deformable manner, thereby fixing the terminal plug 22 in position to an external device.

The thimble base 291 is slidingly disposed onto one end of the terminal plug 22 proximal to the body 21, and a thimble 2911 screwingly disposed onto the thimble base 291 penetrates the terminal plug 22. The pushing member 281 is screwingly disposed on the body 21 and has a mechanism for pushing the thimble base 291. By rotating the pushing member 281, the thimble base 291 is pushed to move towards the terminal plug 22 such that the thimble 2911 spreads the plate pieces 223 of the terminal plug 22 in a resilient deformable manner, thereby fixing the terminal plug 22 in position to the external device. It should be noted that the arrangement of the thimble base 291 and the pushing member 281 can be modified as needed.

The thimble unit 29 of the present embodiment further comprises a resilient element 292 with two ends thereof being in contact with the terminal plug 22 and the thimble base 291, respectively. The resilient element 292 can be a spiral spring, which provides a resilient force to make the thimble base 291 move away from the terminal plug 22 so as to separate the thimble 2911 from the terminal plug 22 and restore the plate pieces 223 of the terminal plug 22 to the original non-resilient-deformable state, thereby disconnecting the terminal plug 22 from the external device. It should be noted that the resilient element 292 is not limited to the spiral spring.

The audio connector of the present embodiment comprises a body, a banana plug, a wire collecting member and a thimble unit. Rotation of the pushing member causes the plate pieces of the banana plug to be spread in a resilient deformable manner or to return to the original non-resilient-deformable state, thereby simplifying the operation and assembly of the audio connector.

The above-described descriptions of the detailed embodiments are only to illustrate the preferred implementation according to the present invention, and it is not to limit the scope of the present invention, Accordingly, all modifications and variations completed by those with ordinary skill in the art should fall within the scope of present invention defined by the appended claims.

What is claimed is:

1. An audio connector, comprising:

a body;

a terminal plug fixed in position to the body and comprising a guide plate penetrating the body for supporting and being electrically connected to conductive ends of a multi-core wire;

a wire collecting member disposed inside the body and configured to define, together with the guide plate, a receiving space for receiving and collecting the conductive ends of the multi-core wire; and a pressing member disposed inside the wire collecting member for pressing, in conjunction with the guide plate and the wire collecting member, the conductive ends of the multi-core wire, wherein a maximum width of the receiving space is smaller than or equal to that of a pressing surface of the pressing member, thereby fixing the multi-core wire in position to the terminal plug, wherein the wire collecting member has a groove facing the guide plate for collecting the conductive ends of the multi-core wire, and a maximum width of the groove is smaller than or equal to that of the pressing surface of the pressing member.

2. The audio connector of claim 1, further comprising a pin for fixing the terminal plug in position to the body.

3. The audio connector of claim 1, wherein the body further has a through hole for receiving the pressing member entering the wire collecting member.

4. The audio connector of claim 3, wherein the pressing member is a screw and the through hole is a screw hole.

5. The audio connector of claim 1, wherein the body further has an opening exposing a portion of the conductive ends of the multi-core wire.

6. The audio connector of claim 1, wherein the guide plate has a concave portion for collecting the conductive ends of the multi-core wire and a maximum width of the concave portion is smaller than or equal to that of the pressing surface of the pressing member.

7. The audio connector of claim 1, further comprising a casing provided to the body for protecting the body and shielding the body from electromagnetic interference.

8. The audio connector of claim 7, wherein the casing is made of nonmagnetic stainless steel, carbon fiber, or a combination thereof.

9. The audio connector of claim 1, further comprising a holding unit disposed onto one end of the body distal to the terminal plug for holding encircledly an external insulating layer of the multi-core wire.

10. The audio connector of claim 9, wherein the holding unit comprises:

a holding member having holding fingers in contact with an inner wall of the body; and a fixing ring for pushing the holding member to move towards an inside of the body, wherein the holding fingers are pressed by the inner wall of the body so as to hold encircledly the external insulating layer of the multi-core wire.

11. The audio connector of claim 1, wherein the terminal plug is selected from the group consisting of a banana plug, a spade plug, a microphone plug, a TRS plug, a BNC plug, an earphone plug, and a RCA plug.

12. The audio connector of claim 11, further comprising a thimble unit disposed onto one end of the body proximal to the terminal plug and configured to spread plate pieces of the terminal plug in a resilient deformable manner.

13. The audio connector of claim 12, wherein the thimble unit comprises: a thimble base with a thimble penetrating the terminal plug; and a pushing member for pushing the thimble base to move towards the terminal plug so as for the thimble to spread the plate pieces of the terminal plug in a resilient deformable manner.

14. The audio connector of claim 13, wherein the thimble unit further comprises a resilient element with two ends being connected to the terminal plug and the thimble base, respectively, for providing a resilient force to drive the thimble to move away from the terminal plug and to drive the plate pieces of the terminal plug to return to a state prior to resilient deformation.

15. The audio connector of claim 14, wherein the resilient element is a spring.

16. The audio connector of claim 1, wherein the terminal plug is made of copper.

17. The audio connector of claim 1, wherein the terminal plug has an electroplating layer made of Rh or Au.

18. An audio connector, comprising:

a body;

a terminal plug fixed in position to the body and comprising a guide plate penetrating the body for supporting and being electrically connected to conductive ends of a multi-core wire;

a wire collecting member disposed inside the body and configured to define, together with the guide plate, a receiving space for receiving and collecting the conductive ends of the multi-core wire;

a pressing member disposed inside the wire collecting member for pressing, in conjunction with the guide plate and the wire collecting member, the conductive ends of the multi-core wire, wherein a maximum width of the receiving space is smaller than or equal to that of a pressing surface of the pressing member, thereby fixing the multi-core wire in position to the terminal plug; and a casing provided to the body for protecting the body and shielding the body from electromagnetic interference.

19. The audio connector of claim 18, wherein the wire collecting member has a groove facing the guide plate for collecting the conductive ends of the multi-core wire, and a maximum width of the groove is smaller than or equal to that of the pressing surface of the pressing member.

20. An audio connector, comprising:

a body;

a terminal plug fixed in position to the body and comprising a guide plate penetrating the body for supporting and being electrically connected to conductive ends of a multi-core wire;

a wire collecting member disposed inside the body and configured to define, together with the guide plate, a receiving space for receiving and collecting the conductive ends of the multi-core wire;

a pressing member disposed inside the wire collecting member for pressing, in conjunction with the guide plate and the wire collecting member, the conductive ends of the multi-core wire, wherein a maximum width of the receiving space is smaller than or equal to that of a pressing surface of the pressing member, thereby fixing the multi-core wire in position to the terminal plug; and a holding unit disposed onto one end of the body distal to the terminal plug for holding encircledly an external insulating layer of the multi-core wire.

* * * * *